US006533547B2

(12) United States Patent
Anding et al.

(10) Patent No.: US 6,533,547 B2
(45) Date of Patent: Mar. 18, 2003

(54) TURBINE BLADE

(75) Inventors: Dirk Anding, Mülheim an der Ruhr (DE); Burkhard Bischoff-Beiermann, Bochum (DE); Hans-Thomas Bolms, Mülheim an der Ruhr (DE); Michael Scheurlen, Mülheim an der Ruhr (DE); Thomas Schulenberg, Essen (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 59 days.

(21) Appl. No.: 09/796,309

(22) Filed: Feb. 28, 2001

(65) Prior Publication Data

US 2001/0018021 A1 Aug. 30, 2001

Related U.S. Application Data

(63) Continuation of application No. PCT/DE99/02596, filed on Aug. 18, 1999.

(30) Foreign Application Priority Data

Aug. 31, 1998 (DE) ..... 198 39 624

(51) Int. Cl.[7] ..... F04D 29/58

(52) U.S. Cl. ..... 416/97 R; 416/241 R

(58) Field of Search ..... 415/115, 116; 416/96 R, 96 A, 97 R, 97 A, 241 A, 241 B, 241 R

(56) References Cited

U.S. PATENT DOCUMENTS

| | | | | |
|---|---|---|---|---|
| 4,519,745 A | | 5/1985 | Rosman et al. | 416/96 A |
| 5,120,192 A | * | 6/1992 | Ohtomo et al. | 415/115 |
| 5,203,873 A | * | 4/1993 | Corsmeier et al. | 416/96 A |
| 5,383,766 A | * | 1/1995 | Przirembel et al. | 416/92 |
| 5,419,039 A | | 5/1995 | Auxier et al. | 29/889.721 |

FOREIGN PATENT DOCUMENTS

| | | |
|---|---|---|
| DE | 36 15 226 A1 | 11/1987 |
| EP | 0 844 368 A2 | 5/1998 |
| FR | 999.820 | 1/1953 |

* cited by examiner

*Primary Examiner*—Edward K. Look
*Assistant Examiner*—Dwayne J. White
(74) *Attorney, Agent, or Firm*—Laurence A. Greenberg; Werner H. Stemer; Gregory L. Mayback

(57) ABSTRACT

The turbine blade has an internal space through which a coolant fluid is guided and in which stiffening ribs are formed to reinforce and support the external walls. Coolant screens that reduce the cooling of the stiffening ribs, are arranged in front of the stiffening ribs in order to reduce thermal stresses. The turbine blade is preferably a gas turbine blade.

13 Claims, 3 Drawing Sheets

TURBINE BLADE

CROSS-REFERENCE TO RELATED APPLICATION

This application is a continuation of copending International Application No. PCT/DE99/02596, filed Aug. 18, 1999, which designated the United States.

BACKGROUND OF THE INVENTION

FIELD OF THE INVENTION

The invention lies in the field of turbine components and relates, more specifically to a turbine blade, in particular a gas turbine blade, having an external wall enclosing an internal space through which coolant fluid can be guided.

The term "blade" is used herein generically to encompass rotor blades and stator vanes.

A guide vane of a gas turbine with a guidance system for cooling air for the cooling of the guide vane is described in U.S. Pat. No. 5,419,039. The guide vane is embodied as a casting or is assembled from two castings. Within it, it has a supply of cooling air from the compressor of the associated gas turbine installation. Cast-in cooling pockets, open to one side, are provided in its wall structure, which encloses the cooling air supply system and is subjected to the hot gas flow of the gas turbine.

The art of turbine components always endeavors to further improve blades and vanes in terms of their internal cooling structures.

SUMMARY OF THE INVENTION

It is accordingly an object of the invention to provide a turbine blade, which overcomes the above-mentioned disadvantages of the heretofore-known devices and methods of this general type and which is further improved with an internal cooling structure.

With the foregoing and other objects in view there is provided, in accordance with the invention, a turbine blade, comprising:

an external wall enclosing an internal space for guiding a coolant fluid;

a stiffening rib in the internal space supporting the external wall, the stiffening rib having a side surface; and a thermally insulating coolant screen disposed adjacent at least a part of the side surface and configured to at least partially screen the side surface from the coolant fluid.

In other words, the objects of the invention are achieved by a turbine blade or vane having an external wall enclosing an internal space for the guidance of a coolant fluid, the external wall being supported in the internal space by a stiffening rib with a side surface, and a thermally insulating coolant screen being arranged in front of at least a part of the side surface in such a way that the side surface can be screened, at least in part, from the coolant fluid by the coolant screen.

A stiffening rib or a plurality of stiffening ribs are arranged in the internal space of the gas turbine blade. These stiffening ribs are used, on the one hand, to stiffen and support the external wall and can, on the other hand, be provided to form two or more partial spaces of the internal space. The coolant fluid is guided over the length of the turbine blade or vane from a root region through the partial spaces to a tip region and emerges there. This corresponds to an open coolant fluid guidance system. A closed coolant fluid guidance system can also be present, i.e. the coolant fluid is guided in a serpentine manner through the partial spaces and out again from the root region.

It is not only the external wall but also the stiffening rib or stiffening ribs which are cooled by the coolant fluid. The stiffening rib is very hot in the transition region to the external wall when the turbine blade or vane is subjected to hot gas. On the other hand, the stiffening rib is very intensively cooled at its side surface or at its side surfaces by the coolant fluid flowing past. Temperature gradients therefore occur within the stiffening rib and these can lead to large thermal stresses, particularly in the transition region between the stiffening rib and the external wall. Such thermal stresses can lead to material fatigue and to a shortened turbine blade or vane life.

Based on this knowledge, the invention provides a measure for reducing the cooling of the stiffening rib. The side surfaces of the stiffening rib, or at least a part of them, are screened from direct contact with the coolant fluid by the thermally insulating coolant screen. The heat transfer between the coolant fluid and the stiffening rib is therefore substantially reduced. In consequence, the stiffening rib is no longer so intensively cooled and the temperature gradient within the stiffening rib is reduced. The thermal stresses occurring within the turbine blade or vane are also reduced by this means.

In accordance with an added feature of the invention, the coolant screen is a coating on the side surface. This coating is expediently executed in a material with good thermal insulation.

In accordance with an additional feature of the invention, the coolant screen is located at a distance from the side surface by means of a gap with a given gap width. The coolant fluid flows very much more slowly in such a gap than it does in the internal space because of a high flow resistance. This reduces the convective cooling of the side surface. It can also be expedient to completely seal the gap against entry by the coolant fluid.

Openings are preferably provided in the coolant screen for an inlet or outlet of coolant fluid into the gap. By means of such openings, it is possible to set to a controlled flow of coolant fluid in the gap. Depending on the magnitude of this flow, there is a higher or lower heat transfer between the stiffening rib and the coolant fluid. It is therefore possible, in a simple manner, to set a value for the heat transfer at which the stiffening rib is sufficiently cooled but, in any event, not so strongly that thermal stresses become excessively large. A distance retainer for setting the gap width is preferably arranged between the coolant screen and the side surface. Another preferred feature is that the distance retainer is a part of the coolant screen. The distance retainer is preferably formed by a bulge in the coolant screen. Such a distance retainer can also be an independent component arranged between coolant screen and side surface. The distance retainer can likewise be a part of the stiffening rib on the side surface. In a particularly simple embodiment of the distance retainer, a bulge is provided in the coolant screen by means of which the coolant screen is in contact with the side surface.

The coolant screen is preferably a metal sheet.

In accordance with a further feature of the invention, the coolant screen is retained on the external wall by means of a protrusion of the external wall. The protrusion is preferably also a turbulator for generating a turbulent flow in the coolant fluid. Rib-like turbulators can, for example, be provided on the side of the external wall facing toward the internal space. These turbulators are used to generate a turbulent flow in the coolant fluid. The convective cooling of the external wall by the coolant fluid is improved by such a turbulent flow. The coolant screen can be clamped, in a simple manner, between the stiffening rib and one or a plurality of such turbulators. The side of the external wall facing toward the internal space can also, however, contain a protrusion cast with it, for example, and used to retain the coolant screen. This protrusion is specially manufactured for retaining the coolant screen.

The turbine blade has a coolant fluid supply region by means of which the coolant fluid is supplied to the turbine blade or vane. The coolant screen is preferably brazed or welded in the coolant fluid supply region. By the fastening of the coolant screen in the coolant fluid supply region by means, in particular, of brazing or welding, the coolant screen can be fixed in a simple manner without additional thermal stresses being introduced. This is because the location of the fixing, i.e. the coolant fluid supply region, has low thermal loading.

The turbine blade is preferably a gas turbine blade or vane, in particular for a stationary gas turbine. Gas turbine blades and vanes are subjected to particularly high temperatures because of the working medium—a hot gas—which flows around them. In order to increase the efficiency, attempts are made to employ higher gas inlet temperatures for the hot gas entering the turbine. These higher gas inlet temperatures require continually better and more efficient cooling of the gas turbine blades and vanes. In consequence, the problem increasingly arises that thermal stresses in the region of the stiffening rib take on unallowably high values. A decrease in these thermal stresses is therefore of increasing importance for a gas turbine blade or vane.

Other features which are considered as characteristic for the invention are set forth in the appended claims.

Although the invention is illustrated and described herein as embodied in a turbine blade or vane, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
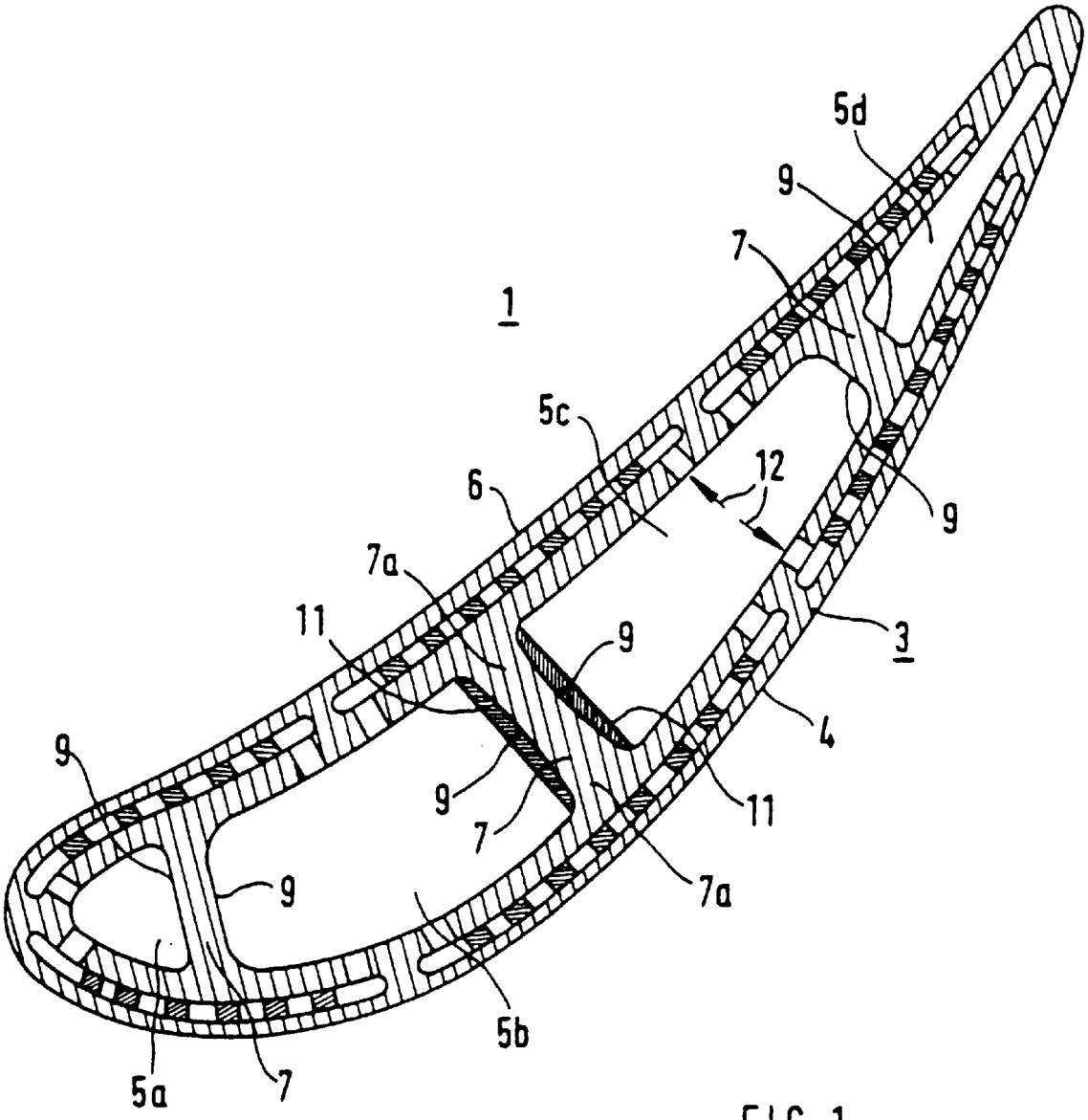
FIG. 1 is a section taken through a gas turbine blade.

Referring now to the figures of the drawing in detail and first, particularly, to FIG. 1 thereof, there is shown a cross section through a gas turbine blade. A double-walled embodiment of an external wall 3, with a suction side 4 (low pressure side) and a pressure side 6 (high pressure side), encloses an internal space 5. Three stiffening ribs 7 are arranged in the internal space 5. Each stiffening rib 7 connects the suction side 4 of the external wall 3 to the pressure side 6. The gas turbine blade or vane 1 is, for example, cast in one piece. Each stiffening rib 7 has two side surfaces 9 directed toward the internal space 5. A coolant screen 11 is arranged before each of the side surfaces 9 of one of the stiffening ribs 7. In the example shown, this is embodied as a coating or a lining in a thermally insulating material.

In operation, the gas turbine blade 1 has a hot gas flowing around the outside of the external wall 3. In order to avoid an unallowably high level of heating of the gas turbine blade 1, the latter is cooled by a coolant fluid 12, which flows through the internal space 5 in a coolant flow direction perpendicular to the plane of the drawing. In this configuration, the internal space 5 is subdivided by the stiffening ribs 7 into four partial spaces 5*a*, 5*b*, 5*c*, 5*d*. The coolant fluid 12 passes through these partial spaces 5*a*, 5*b*, 5*c*, 5*d* in sequence. In the process, it also cools each stiffening rib 7. Since the stiffening rib 7 is connected to the external wall 3, it heats up. Very high temperatures occur, particularly in a transition region 7*a* leading to the external wall 3. At the same time, each stiffening rib 7 is efficiently cooled by the coolant fluid 5 and, in fact, mainly by means of a convective heat exchange via the side surfaces 9. Large thermal stresses occur in the stiffening rib 7 due to a high temperature gradient between the relatively cool side walls 9 and the hot transition regions 7*a* between them and the external wall 3. The coolant screen 11 is used to reduce these thermal stresses. The coolant screen 11 reduces the heat transfer between the stiffening rib 7 and the coolant fluid 5. In consequence, the side walls 9 are no longer so strongly cooled and the temperature gradient between them and the hot external wall 3 is reduced.

Figure 2:
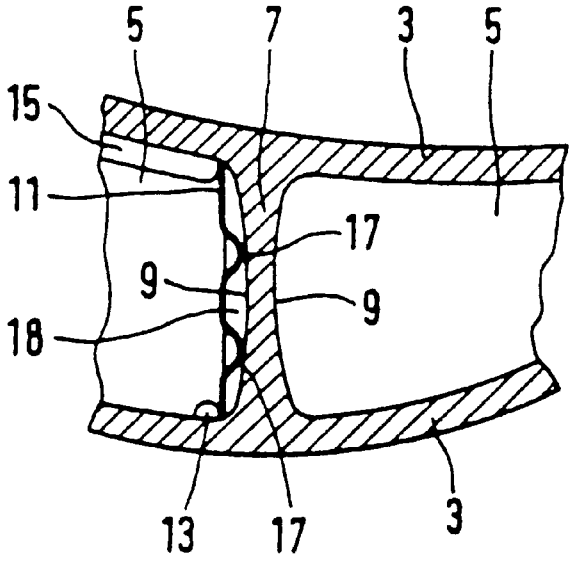
FIG. 2 is a detail of a section through a gas turbine blade.

FIG. 2 shows a detail of a cross section through a gas turbine blade. A stiffening rib 7 corresponding to the embodiment of FIG. 1 is shown. A coolant screen 11 is arranged before one of the side walls 9. The screen is embodied as a metal sheet. Bulges are introduced in the metal sheet and these act as distance retainers 17. A gap 18 with a defined gap width d between the coolant screen 11 and the stiffening ribs 7 is formed by the distance retainers 17. The gap width is preferably between 0.2 mm and 3 mm. The coolant screen 11 is held by a rib-type turbulator 15 on the side facing toward the internal space 5 of the external wall 3 on the pressure side 6. A protrusion 13, which is likewise used for retaining the coolant screen 11, is cast in with the external wall 3 on the side facing toward the internal space 5 of the external wall 3 on the suction side 4.

Only a small amount of the coolant fluid 12 flows in the gap 18. This substantially reduces the convective cooling of the side wall 9. This, in turn, leads to a reduced temperature gradient within the stiffening rib 7 and, therefore, to reduced thermal stresses.

Figure 3:
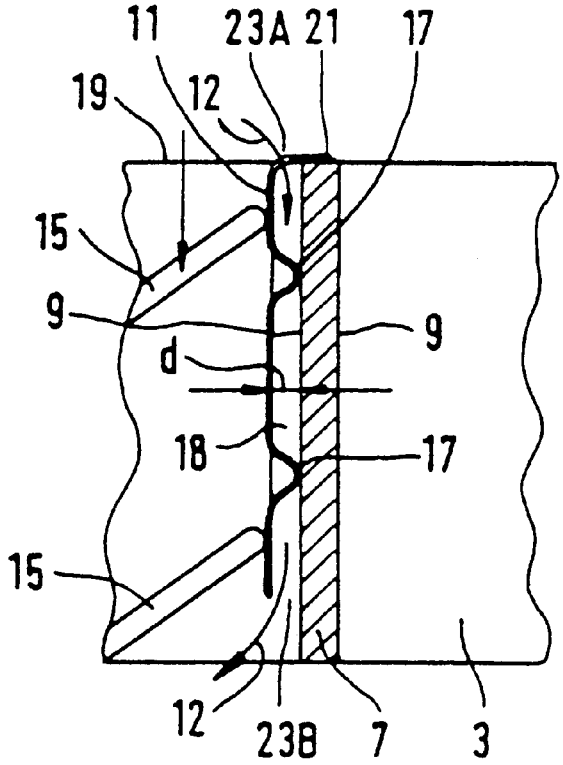
FIG. 3 is a detail of a longitudinal section through a gas turbine blade.

FIG. 3 shows a longitudinal section of the detail of FIG. 2. The coolant fluid 12 flows via a coolant fluid supply region 19 into the internal space 5. The coolant screen 11 is welded to the stiffening rib 7 at a welding location 21 in the coolant fluid supply region 19. The coolant fluid 12 enters the gap 18 at an opening 23A. The coolant fluid 12 emerges from the gap 18 at an opening 23B. By suitably dimensioning the openings 23A, 23B, the coolant fluid flow in the gap 18 can be set in such a way that there is sufficient cooling of the stiffening rib 7 but, at the same time, the cooling still remains sufficiently low so that no unallowably high thermal stresses occur in the turbine blade 1.

Figure 4:
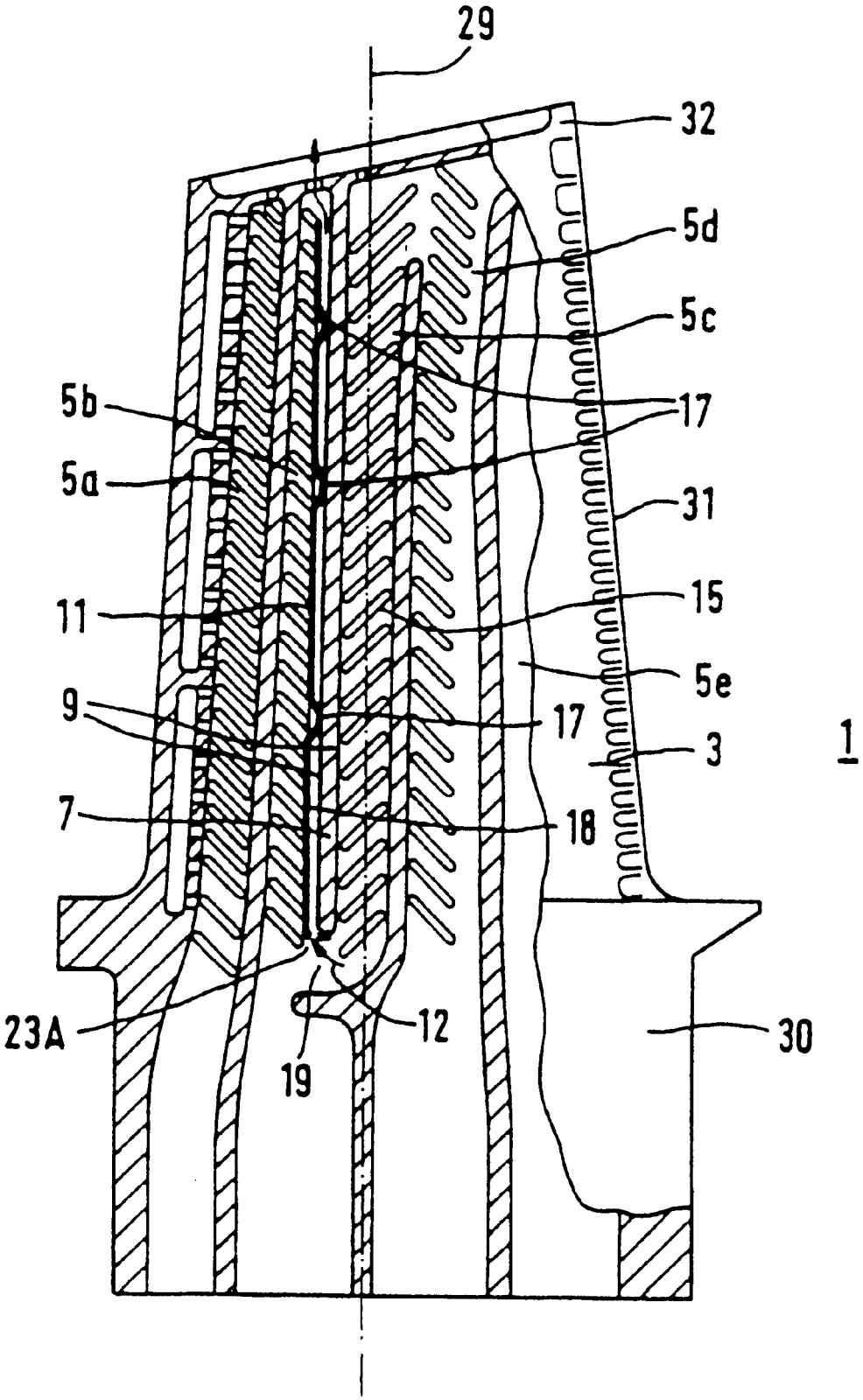
FIG. 4 is a longitudinal section taken through a gas turbine blade.

FIG. 4 shows a gas turbine blade 1 in a partially broken-away view. Along a blade axis 29, the gas turbine blade 1 has a root region 30, a blade airfoil 31 and a tip region 32. An internal space 5, which is subdivided by stiffening ribs 7 with side surfaces 9 into partial spaces 5*a*, 5*b*, 5*c*, 5*d* directed along the blade axis 29, is located within the gas turbine blade 1. A coolant screen 11 is arranged before one of the side walls 9 of one of the stiffening ribs 7. Coolant screens 11 are preferably arranged before all the side walls 9 of all the stiffening ribs 7. The description of the coolant screen 11 and the statement of its advantages correspond to the explanations relative to the other figures.

We claim:

1. A turbine blade, comprising:

an external wall enclosing an internal space for guiding a coolant fluid;

a stiffening rib in said internal space supporting said external wall, said stiffening rib having a side surface; and a thermally insulating coolant screen disposed adjacent at least a part of said side surface and configured to at least partially screen said side surface from the coolant fluid, said coolant screen being a coating on said side surface.

2. The turbine blade according to claim 1, wherein said coolant screen is a metal sheet.

3. In combination with a gas turbine, a turbine blade according to claim 1 formed as a gas turbine blade.

4. The combination according to claim 3, wherein the turbine is a stationary gas turbine.

5. A turbine blade, comprising:

an external wall enclosing an internal space for guiding a coolant fluid;

a stiffening rib in said internal space supporting said external wall, said stiffening rib having a side surface; and a thermally insulating coolant screen disposed adjacent at least a part of said side surface and configured to at least partially screen said side surface from the coolant fluid, said coolant screen being disposed at a distance from said side surface and forming a closed gap with a given gap width therebetween.

6. The turbine blade according to claim 5, which comprises a coolant fluid supply region, and wherein said coolant screen is brazed in said coolant fluid supply region.

7. The turbine blade according to claim 5, which comprises a coolant fluid supply region, and wherein said coolant screen is welded in said coolant fluid supply region.

8. The turbine blade according to claim 5, wherein said external wall is formed with a protrusion configured to retain said coolant screen adjacent said side surface.

9. The turbine blade according to claim 8, wherein said protrusion is a turbulator configured to generate a turbulent flow in the coolant fluid.

10. The turbine blade according to claim 5, which comprises a distance retainer for setting said gap width between said coolant screen and said side surface.

11. The turbine blade according to claim 10, wherein said distance retainer forms a part of said coolant screen.

12. A turbine blade, comprising:

an external wall enclosing an internal space for guiding a coolant fluid;

a stiffening rib in said internal space supporting said external wall, said stiffening rib having a side surface;

a thermally insulating coolant screen disposed adjacent at least a part of said side surface and configured to at least partially screen said side surface from the coolant fluid, said coolant screen being disposed at a distance from said side surface and forming a gap with a given gap width therebetween; and a distance retainer for setting said gap width between said coolant screen and said side surface, said distance retainer forming a part of said coolant screen and being a bulge formed in said coolant screen.

13. A turbine blade, comprising:

an external wall enclosing an internal space for guiding a coolant fluid;

a stiffening rib in said internal space supporting said external wall, said stiffening rib having a side surface; and a thermally insulating coolant screen disposed adjacent at least a part of said side surface and configured to at least partially screen said side surface from the coolant fluid, said coolant screen being disposed at a distance from said side surface and forming a gap with a given gap width therebetween, said coolant screen being formed with openings for exchanging coolant fluid with said gap, the coolant fluid flowing in said gap slower than in said internal space.

* * * * *